US010337363B2

(12) United States Patent
Yamakawa et al.

(10) Patent No.: US 10,337,363 B2
(45) Date of Patent: Jul. 2, 2019

(54) VALVE OPENING AND CLOSING TIMING CONTROL APPARATUS

(71) Applicant: AISIN SEIKI KABUSHIKI KAISHA, Kariya-shi, Aichi (JP)

(72) Inventors: Yoshiaki Yamakawa, Toyota (JP); Masaki Kobayashi, Okazaki (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 125 days.

(21) Appl. No.: 15/501,954

(22) PCT Filed: Oct. 28, 2015

(86) PCT No.: PCT/JP2015/080360
§ 371 (c)(1),
(2) Date: Feb. 6, 2017

(87) PCT Pub. No.: WO2016/068178
PCT Pub. Date: May 6, 2016

(65) Prior Publication Data

US 2017/0234174 A1 Aug. 17, 2017

(30) Foreign Application Priority Data

Oct. 31, 2014 (JP) ..... 2014-222260

(51) Int. Cl.
*F01L 1/344* (2006.01)
*F01L 1/356* (2006.01)

(52) U.S. Cl.
CPC ..... *F01L 1/3442* (2013.01); *F01L 1/356* (2013.01); *F01L 2001/3443* (2013.01);
(Continued)

(58) Field of Classification Search
CPC ..... F01L 2001/3443; F01L 2001/34433; F01L 2001/34463; F01L 1/46
(Continued)

(56) References Cited

U.S. PATENT DOCUMENTS 7,025,023 B2 * 4/2006 Lehmann ..... F01L 1/022 123/90.12
2012/0199086 A1 8/2012 Hori et al.
(Continued)

FOREIGN PATENT DOCUMENTS

DE 19958541 A1 6/2001
JP 2010-249031 A 11/2010
(Continued)

OTHER PUBLICATIONS

Notification of Transmittal of Translation of the International Preliminary Report on Patentability (Forms PCT/IB/338 and PCT/IB/373) and the Written Opinion of the International Searching Authority (Form PCT/ISA/237) issued dated May 2, 2017, by the International Bureau of WIPO in corresponding International Application No. PCT/JP2015/080360. (9 pgs).
(Continued)

*Primary Examiner* — Jorge L Leon, Jr.
(74) *Attorney, Agent, or Firm* — Buchanan Ingersoll & Rooney PC

(57) ABSTRACT

A valve opening and closing timing control apparatus includes a driving-side rotating body, a driven-side rotating body fixed to a camshaft by a bolt, a fluid pressure chamber, an intermediate lock mechanism, a lock flow passage bringing the working fluid to the intermediate lock mechanism, and an electromagnetic valve including a spool which is arranged at an inner portion of the bolt, the lock flow passage including a first flow passage which is arranged between the spool and a supply flow passage in a radial direction and
(Continued)

which is connected to the supply flow passage, the lock flow passage including a second flow passage which is provided at the inner portion of the bolt in a penetrating manner in the radial direction and which brings the working fluid to flow between the spool and the intermediate lock mechanism.

2 Claims, 7 Drawing Sheets

(52) U.S. Cl.
CPC ..... *F01L 2001/34426* (2013.01); *F01L 2001/34433* (2013.01); *F01L 2001/34453* (2013.01); *F01L 2001/34463* (2013.01); *F01L 2001/34466* (2013.01); *F01L 2001/34473* (2013.01)

(58) Field of Classification Search
USPC ..... 123/90.15, 90.17
See application file for complete search history.

(56) References Cited

U.S. PATENT DOCUMENTS

2013/0199475 A1* 8/2013 Schafer ..... F01L 1/3442 123/90.17
2016/0298504 A1 10/2016 Kobayashi et al.
2016/0348542 A1 12/2016 Kobayashi et al.
2017/0218797 A1* 8/2017 Takada ..... F01L 1/356

FOREIGN PATENT DOCUMENTS

JP 2012-036768 A 2/2012
JP 2012036768 A * 2/2012
JP 2012-149600 A 8/2012
JP 2012-163050 A 8/2012
JP WO 2016021280 A1 * 2/2016 ..... F01L 1/356

OTHER PUBLICATIONS

Copending U.S. Appl. No. 15/165,360 (U.S. Application Publication No. US 2016/0348542) naming Masaki Kobayashi, Yoshiaki Yamakawa and Shigyo Hiromitsu as inventors and filed May 26, 2016.
International Search Report (PCT/ISA/210) dated Jan. 26, 2016, by the Japanese Patent Office as the International Searching Authority for International Application No. PCT/JP2015/080360.
Written Opinion (PCT/ISA/237) dated Jan. 26, 2016, by the Japanese Patent Office as the International Searching Authority for International Application No. PCT/JP2015/080360.
The extended European Search Report dated Oct. 13, 2017, by the European Patent Office in corresponding European Application No. 15855542.5. (7 pages).

* cited by examiner

| Amount of power supply | 0 ← → Maximum | | | | |
|---|---|---|---|---|---|
| Discharge flow passage | Drained | Closed | | | Drained |
| Retarded angle flow passage | Drained | | Closed | Supplied | |
| Advanced angle flow passage | Supplied | | Closed | Drained | |
| Lock release flow passage | Closed | Supplied | | | Closed |
| Spool position | W1 | W2 | W3 | W4 | W5 |

VALVE OPENING AND CLOSING TIMING CONTROL APPARATUS

TECHNICAL FIELD

The present invention relates to a valve opening and closing timing control apparatus controlling a relative rotational phase of a driven-side rotating body relative to a driving-side rotating body which rotates synchronously with a crankshaft of an internal combustion engine.

BACKGROUND ART

A known valve opening and closing timing control apparatus locks a relative rotational phase at an intermediate lock phase between a most advanced angle phase and a most retarded angle phase so as to enhance startability of an engine (for example, refer to Patent document 1).

In a valve opening and closing timing control apparatus disclosed in Patent document 1, a driven-side rotating body is fixed to a camshaft of an internal combustion engine by a bolt. A spool is arranged at an inner portion of the bolt to constitute an electromagnetic valve. The spool at which plural annular grooves are provided moves in an axial direction of a driving-side rotating body so that working fluid is supplied to an intermediate lock mechanism via a lock flow passage.

The lock flow passage includes a first flow passage connected to a supply flow passage which brings the working fluid supplied from a pump to flow to an inner portion of the driven-side rotating body along the axial direction so that the working fluid flows towards the spool and a second flow passage which brings the working fluid to flow between the spool and an intermediate lock mechanism. The first flow passage and the second flow passage are provided to penetrate along a radial direction of the bolt and are arranged at different positions from each other in the axial direction.

In a case where the working fluid is supplied to the intermediate lock mechanism, the first flow passage and the second flow passage are connected to each other by the annular grooves at the spool.

DOCUMENT OF PRIOR ART

Patent Document

Patent document 1: JP2012-149600A

OVERVIEW OF INVENTION

Problem to be Solved by Invention

The valve opening and closing timing control apparatus is generally connected to an end portion of a camshaft of an internal combustion engine. Thus, it is desirable to decrease axial dimensions of the internal combustion engine for the purpose of reducing a size thereof. Nevertheless, according to the valve opening and closing timing control apparatus disclosed in Patent document 1, the first flow passage which supplies the working fluid is provided at the different position in the axial direction from the second flow passage which flows the working fluid between the spool and the intermediate lock mechanism. The axial dimensions of the apparatus thus increases, which may require improvement.

It is thus desirable to provide a valve opening and closing timing control apparatus with a reduced size by reasonably configuring a supply flow passage of working fluid to an intermediate lock mechanism.

Means for Solving Problem

According to a characteristic construction of a valve opening and closing timing control apparatus of the present invention, the valve opening and closing timing control apparatus includes a driving-side rotating body rotating synchronously with a crankshaft of an internal combustion engine, a driven-side rotating body arranged coaxially with an axis of the driving-side rotating body and rotating integrally with a camshaft for opening and closing valves of the internal combustion engine in a state being fixed to the camshaft by a bolt, a fluid pressure chamber defined between the driving-side rotating body and the driven-side rotating body, an intermediate lock mechanism selectively switchable between a locked state in which a relative rotational phase of the driven-side rotating body relative to the driving-side rotating body is locked at an intermediate lock phase between a most advanced angle phase and a most retarded angle phase and an unlocked state in which the locked state is released, a lock flow passage bringing a working fluid to the intermediate lock mechanism, and an electromagnetic valve including a spool which is arranged at an inner portion of the bolt and controlling supply and discharge of the working fluid relative to the fluid pressure chamber and the intermediate lock mechanism. The lock flow passage includes a first flow passage which is arranged between the spool and a supply flow passage in a radial direction and which is connected to the supply flow passage, the supply flow passage bringing the working fluid supplied from a pump to flow along the axis direction at the inner portion of the bolt. The lock flow passage includes a second flow passage which is provided at the inner portion of the bolt in a penetrating manner in the radial direction and which brings the working fluid to flow between the spool and the intermediate lock mechanism. At least a portion of the first flow passage and at least a portion of the second flow passage are positioned within a same plane orthogonal to the axis.

According to the aforementioned construction, the driven-side rotating body is fixed to the camshaft by the bolt which is screwed on the camshaft. Thus, it is difficult to determine a connection position between the lock flow passage provided at the driven-side rotating body and the lock flow passage provided at the bolt. Thus, an annular groove is generally formed at a boundary between the driven-side rotating body and the bolt. In a case where the supply flow passage is provided at an inner portion of the driven-side rotating body along the axis direction as disclosed in Patent document 1, it is necessary to arrange the first flow passage which brings the working fluid to flow towards the spool and the second flow passage which brings the working fluid to flow between the spool and the intermediate lock mechanism at different positions from each other in the axis direction so that the first flow passage and the second flow passage are inhibited from joining at the annular groove.

On the other hand, according to the present construction, the supply flow passage through which the working fluid supplied from the pump flows is provided at the inner portion of the bolt along the axis direction. That is, the supply flow passage is configured not to be connected to the annular groove at the boundary between the driven-side rotating body and the bolt. Thus, the construction where at least a portion of the first flow passage arranged between the supply flow passage and the spool and at least a portion of the second flow passage which brings the working fluid to flow between the spool and the intermediate lock mechanism are provided within the same plane orthogonal to the axis is employable. Thus, an axial length of the apparatus may decrease, which leads to a reduced size.

Accordingly, the supply flow passage of the working fluid to the intermediate lock mechanism is reasonably constructed to provide the valve opening and closing timing control apparatus with a reduced size.

According to the other construction, the bolt is constituted by a first member screwed on the camshaft and a second member arranged along an outer surface of the first member. In addition, the supply flow passage is defined between the first member and the second member. Further, the first flow passage is defined at the first member.

Accordingly, in a case where the bolt is constituted at least by the two members as in the present construction, the supply flow passage is provided at a mating surface between the members, for example, so that the supply flow passage may be easily processed as compared to a case where the bolt is constituted by a single member at which the flow passage is formed.

According to the other construction, the second member is press-fitted to the first member along the axis direction.

Accordingly, in a case where the second member is press-fitted to the first member as in the present construction, the both members are firmly connected to each other, thereby inhibiting a position displacement between the members which occurs in conjunction with the rotation of the driven-side rotating body.

According to the other construction, at least an end portion of the second member at an opposite side from the camshaft in the axis direction is press-fitted to the first member. The first flow passage and the second flow passage are arranged at the opposite side from the camshaft in the axis direction relative to a flow passage which supplies and discharges the working fluid to and from the fluid pressure chamber.

The intermediate lock mechanism is generally constructed so that a lock member engages with and disengages from a lock recess portion. A foreign substance may be likely stored at an engagement portion between the lock member and the lock recess portion or a movable area of the lock member. As a result, a control accuracy of the intermediate lock mechanism decreases. On the other hand, in a case where the bolt is constituted by the two members which are press-fitted to each other, a foreign substance (cutting powder) may be generated by a sliding contact between the members upon press-fitting thereof. The foreign substance may possibly enter the intermediate lock mechanism to be stored thereat. Nevertheless, as in the present construction, the lock flow passage is arranged at the opposite side from the camshaft in the axis direction relative to the flow passage which supplies and discharges the working fluid to and from the fluid pressure chamber. Thus, the foreign substance generated by the sliding contact between the two members constituting the bolt is discharged to a front side (camshaft side) in a press-fitting direction. As a result, the foreign substance is restrained from entering the intermediate lock mechanism to thereby inhibit decrease of controllability on the intermediate lock mechanism.

According to the other construction, only a portion of the second member at the opposite side from the camshaft in the axis direction relative to the flow passage which supplies and discharges the working fluid to and from the fluid pressure chamber is fitted to the first member.

Accordingly, as in the present construction, a range of a press-fitting portion is reduced to restrain generation of a foreign substance (cutting powder).

In a case where the valve opening and closing timing control apparatus is in a retention mode of the relative rotational phase in which supply and discharge relative to the fluid pressure chamber is interrupted, the working fluid is likely to leak to the outside from the fluid pressure chamber via a small clearance between components. In this case, the relative rotational phase is unstable and may not be appropriately retained. Nevertheless, as in the present construction, a portion between the first member and the second member where the fluid passage for the supply and discharge relative to the fluid pressure chamber is positioned is not press-fitted, which leads to a small clearance between the members. As a result, the working fluid at the supply flow passage may enter the fluid pressure chamber via the clearance. Accordingly, a lack of the working fluid at the fluid pressure chamber is compensated to restrain instability of the relative rotational phase.

According to the other construction, a fixing member which blocks a movement of the second member relative to the first member in a circumferential direction is provided over the first member and the second member.

Accordingly, in a case where a position displacement of the second member relative to the first member in the circumferential direction along with the rotation of the driven-side rotating body is inhibited by the fixing member as in the present construction, the second member may be mounted to the first member by intermediate fitting or loose fitting. As compared to a case where the members are press-fitted to each other, generation of cutting powder along with the sliding contact between the members may be restrained.

MODE FOR CARRYING OUT THE INVENTION

Embodiments of a valve opening and closing timing control apparatus according to the present invention are explained with reference to the attached drawings. A first embodiment is explained as an embodiment where a valve opening and closing timing control apparatus 10 is employed at intake valves 103 of an internal combustion engine (which is hereinafter referred to as an "engine E"). The valve opening and closing timing control apparatus, however, is not limited to the following embodiments and may be variously modified within a scope of the invention.

[Entire Construction]

Figure 1:
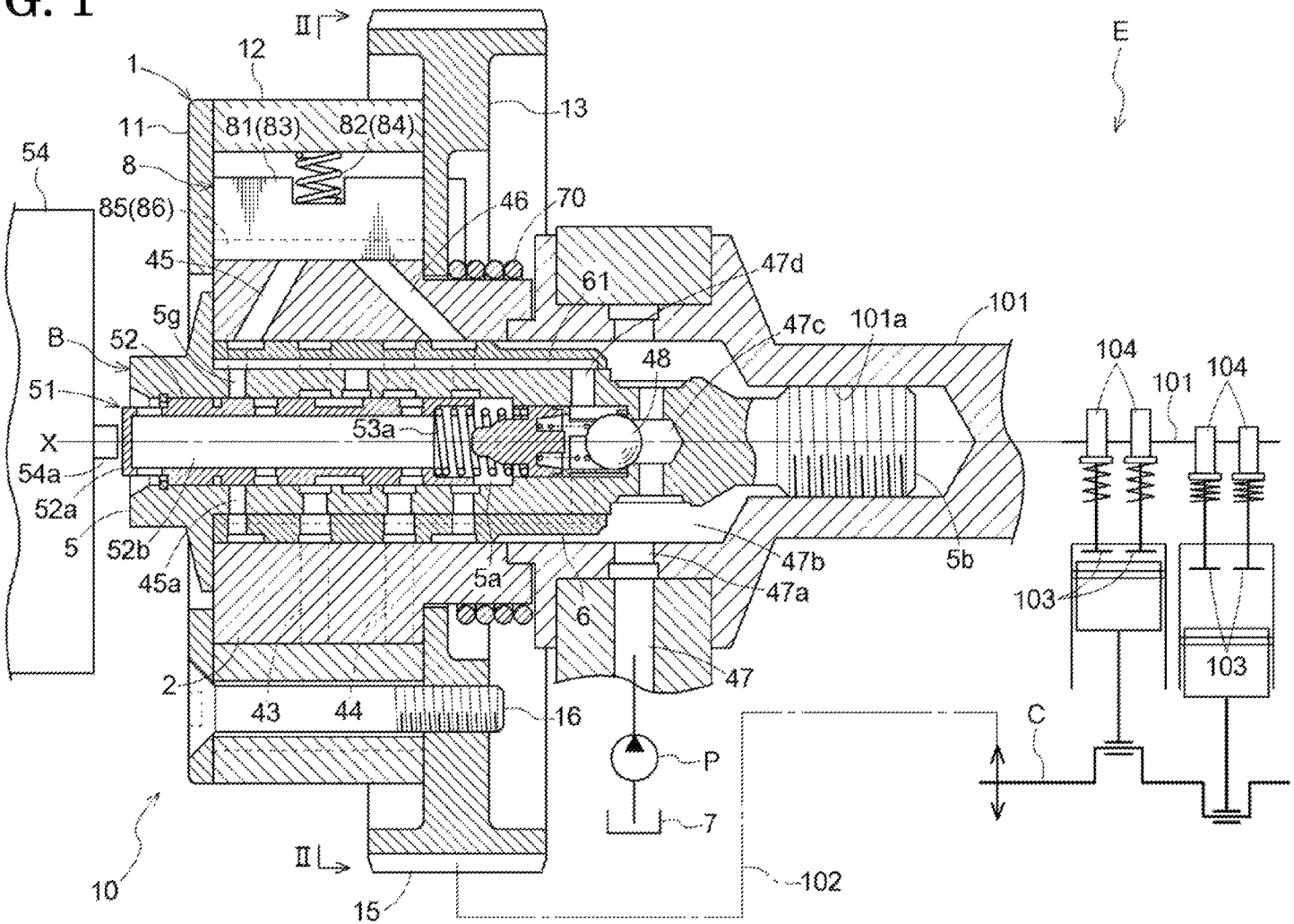
[FIG. 1] is a longitudinal section view of a valve opening and closing timing control apparatus according to a first embodiment.

As illustrated in FIG. 1, the valve opening and closing timing control apparatus 10 includes a housing 1 (an example of a driving-side rotating body) rotating synchronously with a crankshaft C of the engine E and an inner rotor 2 (an example of a driven-side rotating body) rotating integrally with a camshaft 101 for opening and closing valves of the engine E in a state where the inner rotor 2 is fixed to the camshaft 101 by a bolt B. The inner rotor 2 is arranged coaxially with an axis X of the housing 1 at an inner side of the housing 1. The camshaft 101 is a rotation axis of cams 104 which control opening and closing of the intake valves 103 of the engine E. The camshaft 101 rotates synchronously with the inner rotor 2 and the bolt B.

An external threaded portion 5*b* is provided at an end portion of the bolt B at a side close to the camshaft 101. In a state where the housing 1 and the inner rotor 2 are assembled on each other, the bolt B is inserted to a center of the assembly of the housing 1 and the inner rotor 2 so that the external threaded portion 5*b* of the bolt B is screwed on an internal threaded portion 101*a* of the camshaft 101. As a result, the bolt B is fixed to the camshaft 101, and the inner rotor 2 and the camshaft 101 are also fixed to each other.

Figure 9:
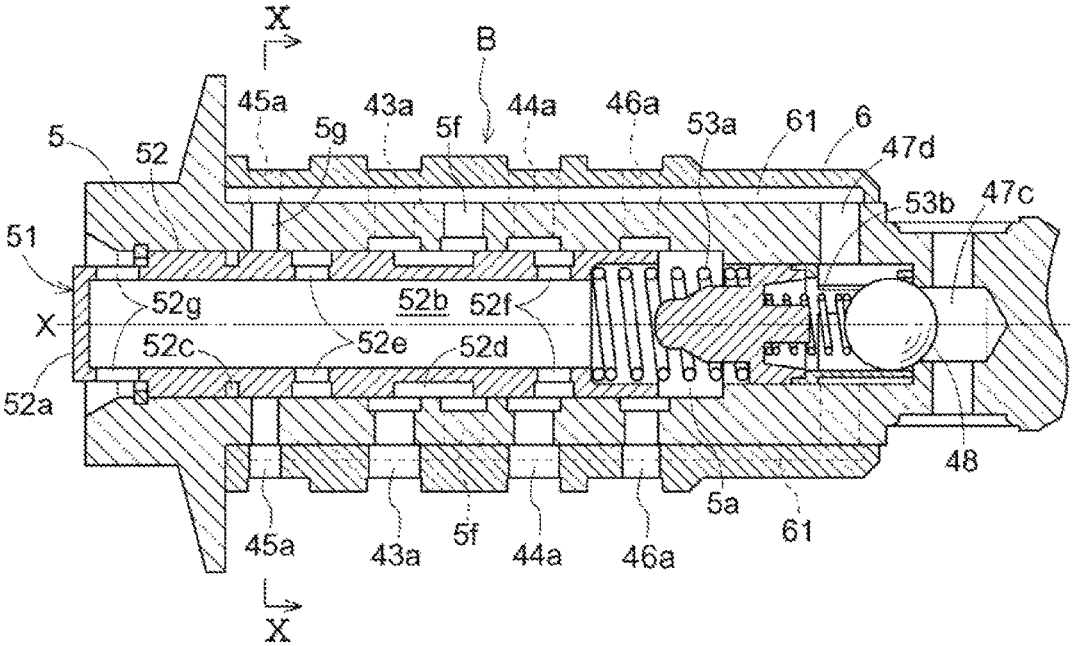
[FIG. 9] is a longitudinal section view of a bolt.
Figure 10:
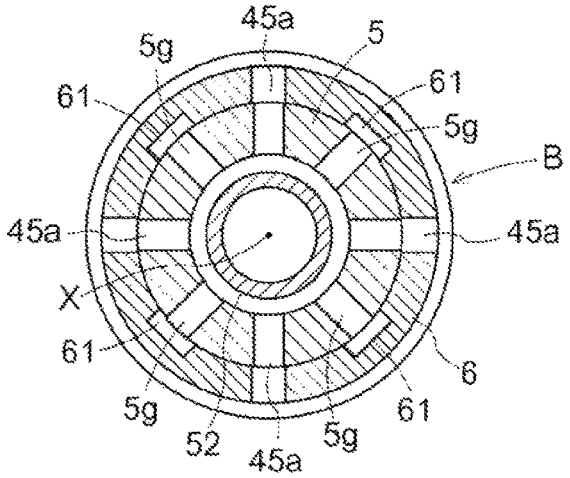
[FIG. 10] is a cross-sectional view taken along a line X-X in FIG. 9.
Figure 11:
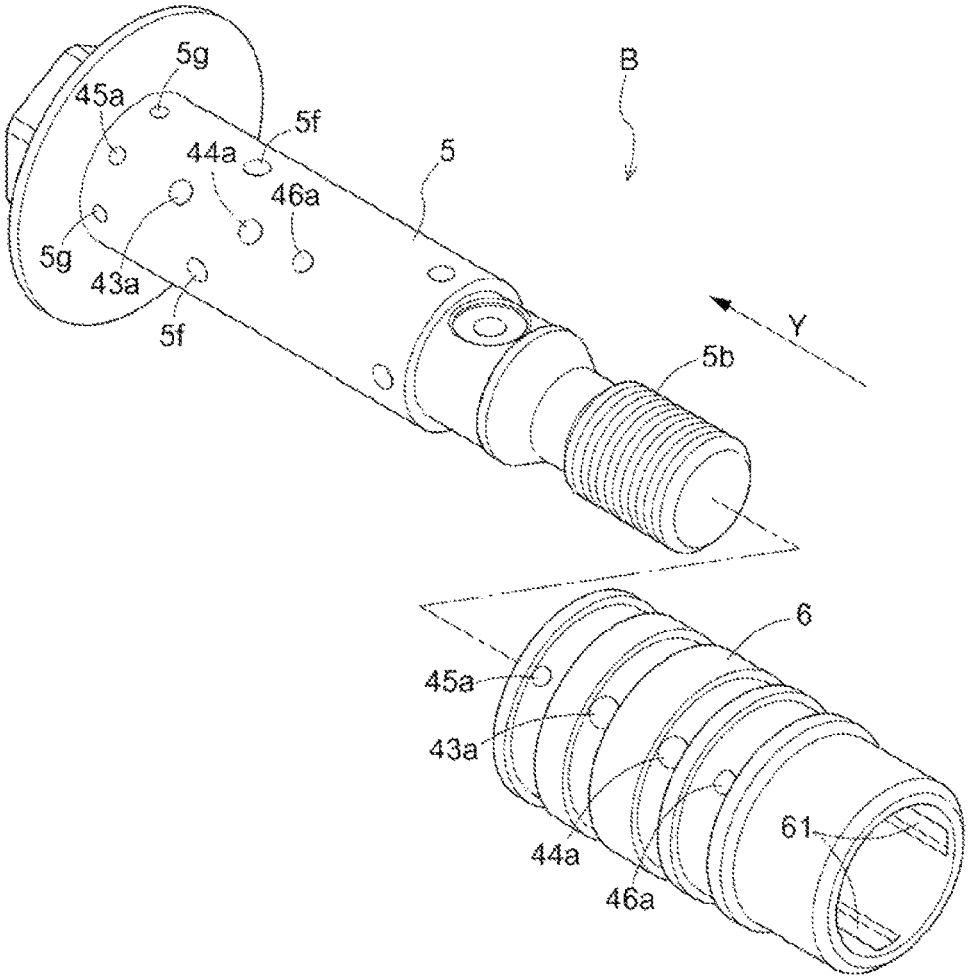
[FIG. 11] is an exploded perspective view illustrating a press-fitting state of the bolt.

As illustrated in FIGS. 9 to 11, the bolt B includes a first member 5 screwed on the camshaft 101 and a second member 6 in a tubular form arranged along an outer surface of the first member 5. In the present embodiment, an entire area of an inner surface of the second member 6 along a circumferential direction and a direction of the axis X is press-fitted to the outer surface of the first member 5.

As illustrated in FIG. 11, the second member 6 is outwardly inserted to the first member 5 from a side of the external threaded portion 5*b* of the first member 5 so that the second member 6 is press-fitted to the first member 5 along the outer surface of the first member 5. At this time, a protruding portion may be provided at the first member 5 along the axis X direction so as to be positioned between a first flow passage 5*g* and a second flow passage 45*a* of a lock flow passage 45 which is explained later in the circumferential direction. The second member 6 may be press-fitted to the first member 5 while the protruding portion is being positioned with a groove portion provided at the second member 6 along the axis X direction. As a result, a press-fitting operation of the second member 6 relative to the first member 5 may be simplified. In this case, instead of the protruding portion of the first member 5 and the groove portion of the second member 6, a groove portion may be provided at the first member 5 while the protruding portion may be provided at the second member 6.

Because the second member 6 is press-fitted to the first member 5, the members 5 and 6 are firmly fixed to each other to inhibit a positioning error between the members 5 and 6 caused by the rotation of the inner rotor 2. In the present embodiment, the entire area of the inner surface of the second member 6 along the axis X direction is press-fitted to the first member 5. Alternatively, a portion of the inner surface of the second member 6 along the axis X direction may be press-fitted to the first member 5.

Figures 2, 3:
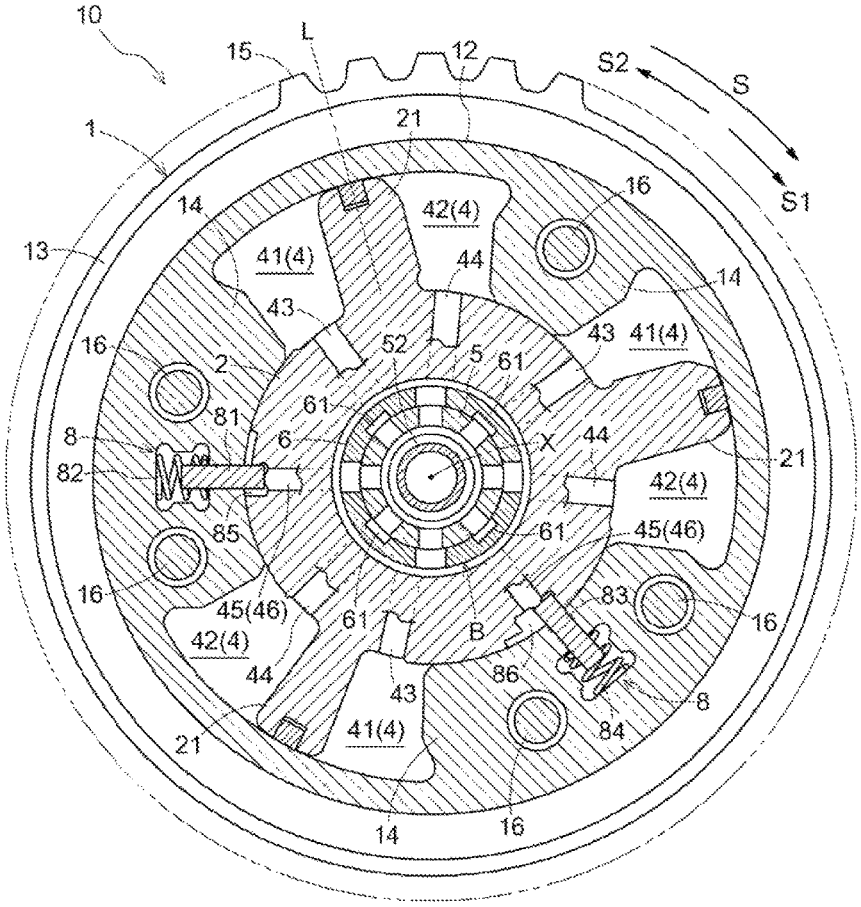
[FIG. 2] is a cross-sectional view taken along a line II-II in FIG. 1.
[FIG. 3] is a diagram illustrating a flow state of oil at each flow passage by an operation of an OCV.

As illustrated in FIG. 1, the housing 1 includes a front plate 11 arranged at a side opposite from a side where the camshaft 101 is connected, an outer rotor 12 externally mounted to the inner rotor 2 and a timing sprocket 15. The housing 1 is configured so that the front plate 11, the outer rotor 12, the timing sprocket 15 and a rear plate 13 arranged at the side where the camshaft 101 is connected are assembled on one another by fastening bolts 16. In addition, as illustrated in FIG. 2, fluid pressure chambers 4 are provided to be defined between the inner rotor 2 and the outer rotor 12. The inner rotor 2 and the outer rotor 12 are configured to be relatively rotatable about the axis X.

A return spring 70 is provided between the housing 1 and the camshaft 101 for applying a biasing force in a rotation direction about the axis X. The return spring 70 applies the biasing force until a relative rotational phase of the inner rotor 2 relative to the housing 1 (which is hereinafter also simply referred to as a "relative rotational phase") reaches a predetermined relative rotational phase at an advanced angle side from a state where the relative rotational phase is at a most retarded angle. The return spring 70 may be disposed between the housing 1 and the inner rotor 2.

In a case where the crankshaft C is driven to rotate, a rotation drive force of the crankshaft C is transmitted to the timing sprocket 15 via a power transmission member 102 so that the housing 1 is driven to rotate in a rotation direction S illustrated in FIG. 2. The inner rotor 2 is driven to rotate in the rotation direction S in conjunction with the rotation drive of the housing 1 to thereby rotate the camshaft 101. The cams 104 provided at the camshaft 101 press down to open the intake valves 103 of the engine E.

As illustrated in FIG. 2, three projecting portions 14 protruding radially inward are provided at the outer rotor 12 so as to be spaced away from one another along the rotation direction S. The fluid pressure chambers 4 are thus defined between the inner rotor 2 and the outer rotor 12. In addition, protruding portions 21 are provided at portions of an outer peripheral surface of the inner rotor 2 facing the respective fluid pressure chambers 4. The protruding portions 21 make contact with an inner peripheral surface of the outer rotor 12. Each of the protruding portions 21 divides each of the fluid pressure chambers 4 into an advanced angle chamber 41 and a retarded angle chamber 42. In the present embodiment, the number of the fluid chambers 4 is three, however, the number of the fluid chambers 4 is not limited thereto.

Oil is supplied to or discharged from the advanced angle chambers 41 and the retarded angle chambers 42 or supply and discharge of the oil is interrupted so as to change the relative rotational phase to an advanced angle direction or to a retarded angle direction, or to maintain the relative rotational phase at an arbitral phase. The advanced angle direction corresponds to a direction in which a volume of the advanced angle chambers 41 increases as indicated by an arrow S1 in FIG. 2. The retarded angle direction corresponds to a direction in which a volume of the retarded angle chambers 42 increases as indicated by an arrow S2 in FIG. 2. The relative rotational phase in a state where the protruding portion 21 reaches a moving end or in the vicinity thereof in the advanced angle direction S1 is referred to as a most advanced angle phase. The relative rotational phase in a state where the protruding portion 21 reaches a moving end or in the vicinity thereof in the retarded angle direction S2 is referred to as a most retarded angle phase.

As illustrated in FIG. 2, advanced angle flow passages 43 in communication with the respective advanced angle chambers 41, retarded angle flow passages 44 in communication with the respective retarded angle chambers 42, the lock flow passages 45 bringing the oil to flow to intermediate lock mechanisms 8 which are explained later and lock discharge flow passages 46 where the oil flows to be discharged to the outside from the intermediate lock mechanisms 8 are provided at the inner rotor 2. As illustrated in FIG. 1, according to the valve opening and closing timing control apparatus 10, the oil stored at an oil pan 7 of the engine E is supplied to and discharged from the advanced angle chambers 41, the retarded angle chambers 42 and the intermediate lock mechanisms 8.

[Intermediate Lock Mechanism]

The valve opening and closing timing control apparatus 10 of the present embodiment includes the intermediate lock mechanisms 8 which lock the relative rotational phase at an intermediate lock phase L between the most advanced angle phase and the most retarded angle phase. The relative rotational phase is locked at the intermediate lock phase L under the condition that an oil pressure is not stable immediately after the engine start so that the stable rotation of the engine E may be realized.

As illustrated in FIG. 2, the intermediate lock mechanisms 8 include a first lock member 81, a first spring 82, a second lock member 83, a second spring 84, a first recess portion 85 and a second recess portion 86.

Each of the lock members 81 and 83 is constituted by a plate-formed member and is movably supported at the outer rotor 12 so as to come close to or separate from the inner rotor 2 in a state being positioned orthogonal to the axis X. Each of the lock members 81 and 83 may be configured to come close to or separate from the front plate 11 or the rear plate 13 in a state being positioned parallel to the axis X. In addition, the number of the intermediate lock mechanisms 8 is not limited to two and may be one or more than three.

Each of the recess portions 85 and 86 is formed in a manner that a shallow groove and a deep groove are connected to each other in the circumferential direction. As illustrated in FIG. 2, at the intermediate lock phase L in a state where the oil is not present at the recess portions 85 and 86, the first lock member 81 makes contact with an end portion of the deep groove of the first recess portion 85 in the advanced angle direction S1 by a biasing force of the first spring 82 to restrict the inner rotor 2 from changing to the retarded angle direction S2. The second lock member 83 makes contact with an end portion of the deep groove of the second recess portion 86 in the retarded angle direction S2 by a biasing force of the second spring 84 to restrict the inner rotor 2 from changing to the advanced angle direction S1. The above state corresponds to a locked state.

The lock flow passages 45 are connected to respective bottom surfaces of the deep grooves of the first recess portion 85 and the second recess portion 86. In a case where the oil is supplied to the recess portions 85 and 86 through the lock flow passages 45 in a case of the locked state, each of the lock members 81 and 83 receives a pressure of the oil. In a case where the oil pressure exceeds the biasing force of each of the springs 82 and 84, the lock members 81 and 83 separate from the recess portions 85 and 86, which results in an unlocked state.

The lock discharge flow passages 46 are also connected to the respective bottom surfaces of the deep grooves of the recess portions 85 and 86. The lock discharge flow passages 46 are not the flow passages for supplying the oil to the intermediate lock mechanisms 8 but are the flow passages for discharging the oil to the outside.

[Electromagnetic Valve]

As illustrated in FIG. 1, in the present embodiment, an OCV 51 (an oil control valve serving as an example of an electromagnetic valve) is arranged coaxially with the axis X at an inner portion of the bolt B. The OCV 51 is configured by including a spool 52, a first spring 53*a* biasing the spool 52 and an electromagnetic solenoid 54 driving the spool 52. The electromagnetic solenoid 54 is obtained by a known technique and thus a detailed explanation is omitted.

The spool 52 is housed at a housing void 5*a* which is provided at the inner portion of the bolt B and which serves as a circular bore in a cross-section. The spool 52 is slidable along the axis X direction within the housing void 5*a*. The spool 52 includes a main discharge flow passage 52*b* serving as a hole with a bottom in a circular cross-section and extending along the axis X direction.

In a case where the electromagnetic solenoid 54 is powered, a push pin 54*a* provided at the electromagnetic solenoid 54 presses an end portion 52*a* of the spool 52. As a result, the spool 52 slidably moves towards the camshaft 101 against a biasing force of the first spring 53*a*. The OCV 51 is configured to adjust a position of the spool 52 by changing an amount of power supply to the electromagnetic solenoid 54 from zero to maximum. The amount of power supply to the electromagnetic solenoid 54 is controlled by an ECU (electronic control unit) not illustrated.

The OCV 51 switches between supply, discharge and retention of the oil relative to the advanced angle chambers 41 and the retarded angle chambers 42 depending on the position of the spool 52 and switches between supply and discharge of the oil to the intermediate lock mechanisms 8.

[Construction of Oil Passage]

As illustrated in FIG. 1, the oil stored at the oil pan 7 is pumped by a mechanical-type pump P which is driven by receiving the rotation drive force of the crankshaft C. Next, the oil flows through supply flow passages 61 each of which is formed in a recess form along the axis X at the inner surface of the second member 6 within the bolt B. The oil which flows through the supply flow passages 61 is then supplied to the advanced angle flow passages 43, the retarded angle flow passages 44 and the lock flow passages 45.

As illustrated in FIGS. 4 to 8, the oil supplied from the pump P flows through a first penetration passage 47*a* provided at the camshaft 101, a first annular flow passage 47*b* serving as a void between the camshaft 101 and the bolt B, a second penetration passage 47*c* provided at the bolt B, a third penetration passage 47*d* provided at the bolt B and the supply flow passages 61 provided at the second member 6 of the bolt B in the mentioned order. A check valve 48 is provided at the second penetration passage 47*c* so as to be biased by a second spring 53*b* in a direction for closing the second penetration passage 47*c*.

A first annular groove 52*c* for supplying the oil which flows through the supply flow passages 61 to the lock flow passages 45 and a second annular groove 52*d* for supplying the oil to the advanced angle flow passages 43 or the retarded angle flow passages 44 are provided at the spool 52. In addition, a first penetration passage 52*e* for discharging the oil that flows through the advanced angle flow passages 43 to the main discharge flow passage 52*b* and a second penetration passage 52*f* for discharging the oil that flows through the retarded angle flow passages 44 or the lock discharge flow passages 46 to the main discharge flow passage 52*b* are provided at the spool 52. Further, a third penetration passage 52*g* for discharging the oil that flows through the main discharge flow passage 52*b* to the outside of the valve opening and closing timing control apparatus 10 is provided at the spool 52.

Each of the advanced angle flow passages 43 connected to the advanced angle chamber 41 includes a first penetration passage 43*a* provided by penetrating through the first member 5 and the second member 6 of the bolt B in the radial direction and a second penetration passage 43*b* connected to the first penetration passage 43*a* and provided at the inner rotor 2. In the same manner, each of the retarded angle flow passages 44 connected to the retarded angle chamber 42 includes a first penetration passage 44*a* provided by penetrating through the first member 5 and the second member 6 of the bolt B in the radial direction and a second penetration passage 44*b* connected to the first penetration passage 44*a* and provided at the inner rotor 2. In each of the first penetration passages 43*a* and 44*a*, an annular groove is provided at a boundary portion relative to the inner rotor 2. The advanced angle flow passage 43 and the retarded angle flow passage 44 shares a common supply penetration passage 5*f* provided by penetrating through the first member 5 of the bolt B in the radial direction and connected to the supply flow passage 61.

Each of the lock flow passages 45 connected to the intermediate lock mechanism 8 is arranged between the supply flow passage 61 and the spool 52 in the radial direction. The lock flow passage 45 includes the first flow passage 5*g* connected to the supply flow passage 61. The first flow passage 5*g* is defined and provided at the first member 5 of the bolt B. In the present embodiment, the bolt B is constituted by two members so that the supply flow passages 61 or the first flow passages 5*g*, for example, are easily processed as compared to a case where the bolt B is constituted by a single member at which flow passages are formed. In addition, each of the lock flow passages 45 includes the second flow passage 45*a* provided by penetrating through the first member 5 and the second member 6 of the bolt B in the radial direction and a third flow passage 45*b* connected to the second flow passage 45*a* and provided at the inner rotor 2. That is, the first flow passage 5*g* serves as a path for bringing the oil which flows from the supply flow passage 61 to flow towards the spool 52 while the second flow passage 45*a* serves as a path for bringing the oil to flow between the spool 52 and the intermediate lock mechanism 8. In the second flow passage 45*a*, an annular groove is provided at a boundary portion relative to the inner rotor 2.

Each of the lock discharge flow passages 46 connected to the intermediate lock mechanism 8 is constituted by a first penetration passage 46*a* provided by penetrating through the first member 5 and the second member 6 of the bolt B in the radial direction and a second penetration passage 46*b* connected to the first penetration passage 46*a* and provided at the inner rotor 2. In the first penetration passage 46*a*, an annular groove is provided at a boundary portion relative to the inner rotor 2.

As illustrated in FIGS. 9 and 10, in the lock flow passages 45, the plural first flow passages 5*g* and the plural second flow passages 45*a* are alternately arranged at even intervals in the circumferential direction as viewed in the axis X direction. Specifically, at least a portion of each of the first flow passages 5*g* and at least a portion of each of the second flow passages 45*a* are positioned within the same plane orthogonal to the axis X. That is, a first imaginary line passing through the first flow passage 5*g* and extending in an orthogonal direction to the axis X direction and a second imaginary line passing through the second flow passage 45*a* and extending in the orthogonal direction to the axis X direction overlap each other as viewed in the orthogonal direction to the axis X direction. Thus, as compared to a case where the first flow passages 5*g* and the second flow passages 45*a* are arranged at different positions in the axis X direction, an axial length of the valve opening and closing timing control apparatus 10 may be reduced. The concept that at least a portion of the first flow passage 5*g* and at least a portion of the second flow passage 45*a* are positioned within the same plane orthogonal to the axis X includes not only a case where a center of the first flow passage 5*g* and a center of the second flow passage 45*a* are positioned within the same plane but also a case where the first flow passage 5*g* and the second flow passage 45*a* are slightly displaced from each other in the axis X direction.

The plural first flow passages 5*g* and the plural second flow passages 45*a* are provided for securing a flow area so that supply or discharge of the oil relative to the intermediate lock mechanisms 8 may be promptly performed. In addition, because the first flow passages 5*g* and the second flow passages 45*a*, each of the first flow passages 5*g* and each of the second flow passages 45*a* including different lengths from each other, are alternately arranged at even intervals within the same plane, a rotation balance of the inner rotor 2 may be stabilized.

[Operation of OCV]

Figure 4:
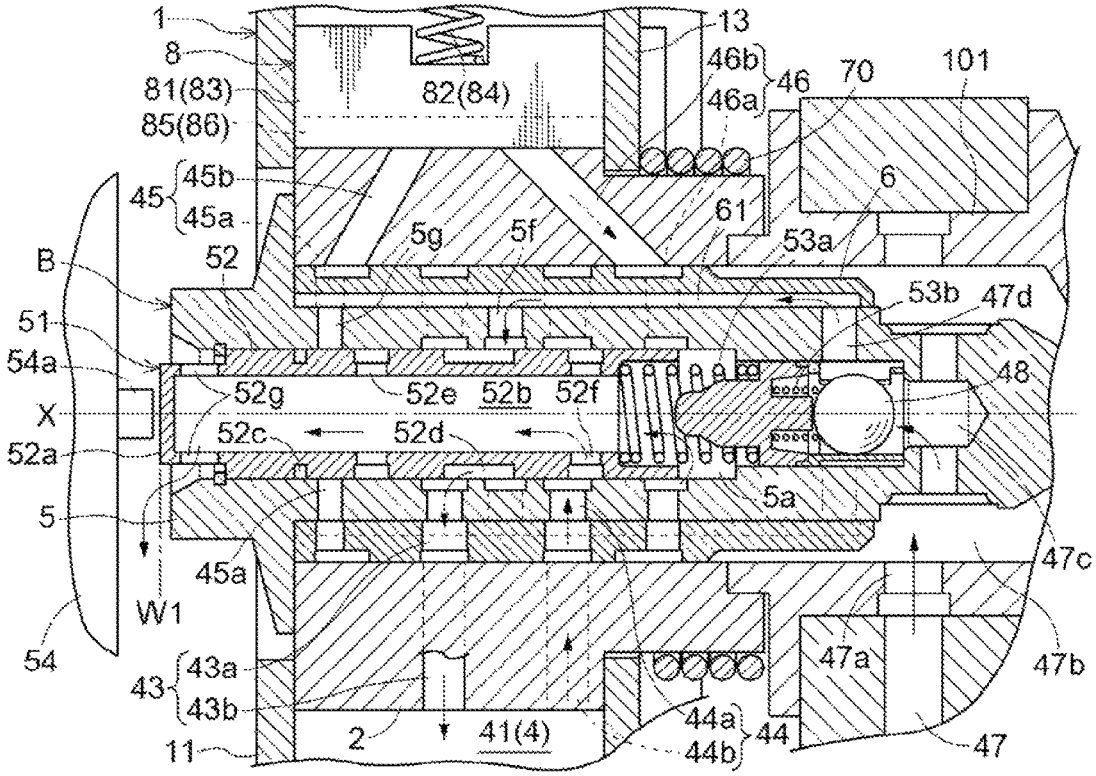
[FIG. 4] is an enlarged cross-sectional view illustrating an operation state of the OCV at W1 in FIG. 3.

An operation construction of the OCV 51 in a case where the position of the spool 52 changes between W1, W2, W3, W4 and W5 depending on the amount of power supply to the electromagnetic solenoid 54 is illustrated in FIG. 3. As illustrated in FIG. 4, in a case where the electromagnetic solenoid 54 is not powered, the spool 52 makes contact with a stopper by the biasing force of the first spring 53*a* so that the spool 52 is at the most leftward position (W1 in FIG. 3). In the aforementioned state, the oil which is supplied flows through the first penetration passage 47*a*, the first annular flow passage 47*b* and the second penetration passage 47*c* in the mentioned order. When the oil pressure exceeds a biasing force of the second spring 53*b*, the check valve 48 is opened. Next, the oil flows through the third penetration passage 47*d* and the supply flow passages 61 in the mentioned order to reach the supply penetration passages 5*f* of the advanced angle flow passages 43 and the retarded angle flow passages 44 and the first flow passages 5*g* of the lock flow passages 45. Because the second annular groove 52*d* is connected to the advanced angle flow passages 43, the oil is supplied to the advanced angle chambers 41. On the other hand, because the retarded angle flow passages 44 are connected to the second penetration passage 52*f*, the oil at the retarded angle chambers 42 is brought to a state being drained. In addition, the lock flow passages 45 are inhibited from being connected to the first annular groove 52*c* or the first penetration passage 52*e* while the lock discharge flow passages 46 are connected to the housing void 5*a*. The oil at the intermediate lock mechanisms 8 is therefore brought to the drained state. As a result, each of the intermediate lock mechanisms 8 is in the locked state.

Figure 5:
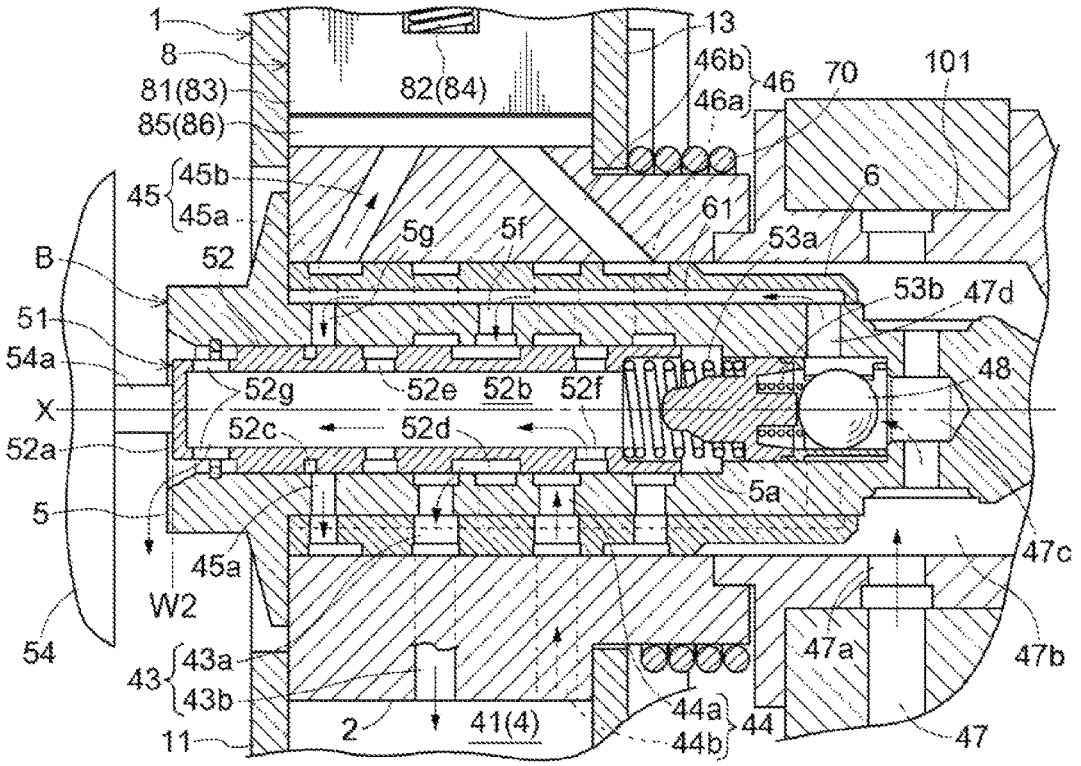
[FIG. 5] is an enlarged cross-sectional view illustrating an operation state of the OCV at W2 in FIG. 3.

In a case where the electromagnetic solenoid 54 is powered, the spool 52 moves slightly rightward from the state of W1, as illustrated in FIG. 5 (W2 in FIG. 3). In the aforementioned state, the lock flow passages 45 are connected to the first annular groove 52*c* so that the oil is supplied to the intermediate lock mechanisms 8. At this time, because the lock discharge flow passages 46 are inhibited from being connected to the housing void 5*a*, the oil at the intermediate lock mechanisms 8 is inhibited from being discharged to the outside via the lock discharge flow passages 46. Thus, in a case where the oil pressure exceeds the biasing force of each of the springs 82 and 84, the lock members 81 and 83 separate from the recess portions 85 and 86, which results in the unlocked state. The advanced angle flow passages 43 and the retarded angle flow passages 44 are in the similar states to states in W1, i.e., the oil is supplied to the advanced angle chambers 41 and the oil at the retarded angle chambers 42 is brought to the drained state.

Figure 6:
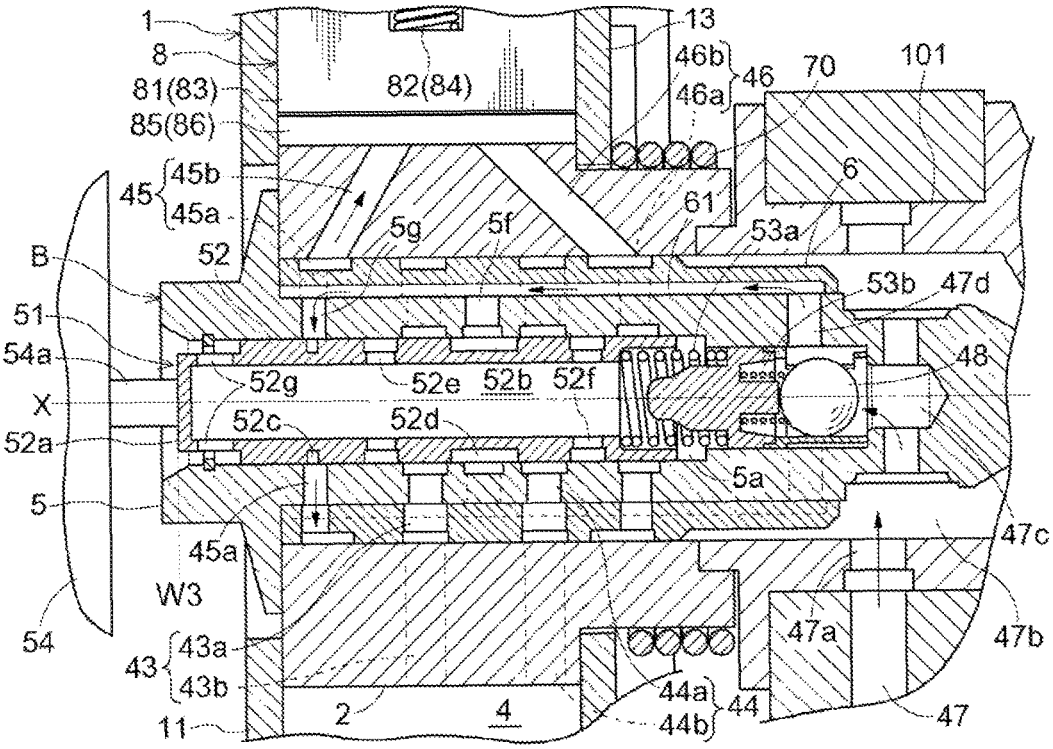
[FIG. 6] is an enlarged cross-sectional view illustrating an operation state of the OCV at W3 in FIG. 3.

In a case where the electromagnetic solenoid 54 is further powered, the spool 52 moves slightly rightward from the state of W2, as illustrated in FIG. 6 (W3 in FIG. 3). At this time, the state in W3 differs from the state in W2 in that the advanced angle flow passages 43 and the retarded angle flow passages 44 are inhibited from being connected to the second annular groove 52*d*, the first penetration passage 52*e* or the second penetration passage 52*f*. Therefore, the supply and discharge of the oil relative to the advanced angle chambers 41 and the retarded angle chambers 42 is interrupted. The inner rotor 2 retains the relative rotational phase without any change and is inhibited from changing to the advanced angle direction S1 or the retarded angle direction S2. Such state corresponds to a phase retention mode.

Figure 7:
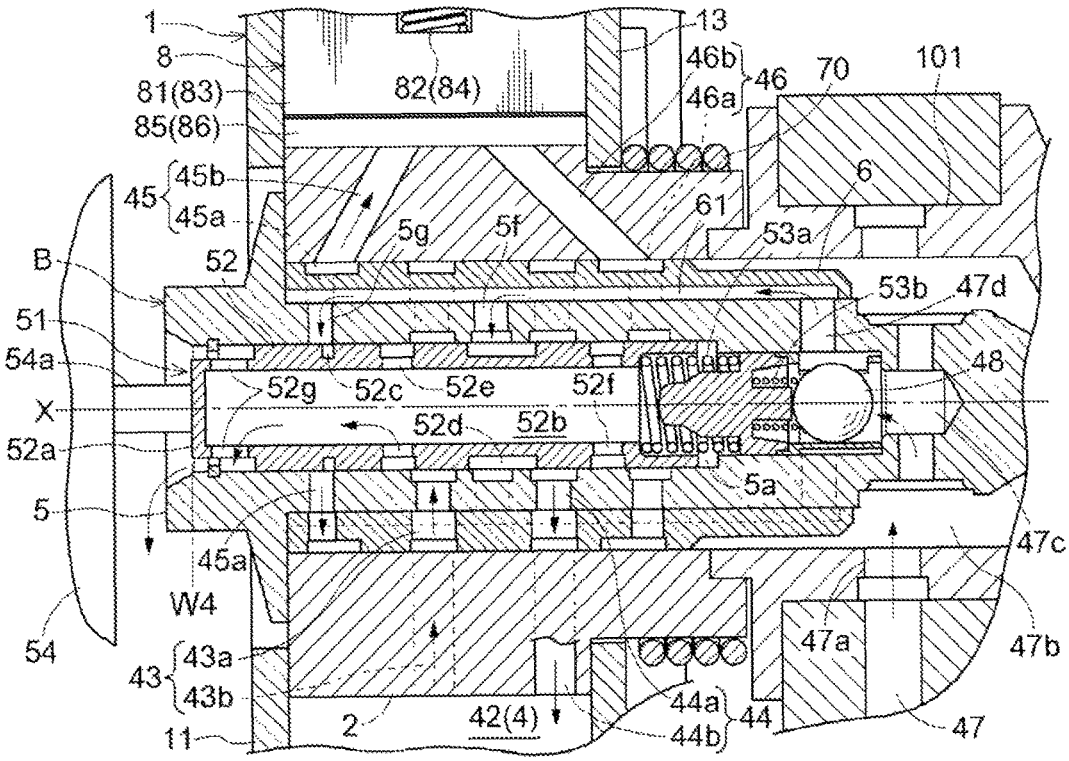
[FIG. 7] is an enlarged cross-sectional view illustrating an operation state of the OCV at W4 in FIG. 3.

In a case where the electromagnetic solenoid 54 is further powered as illustrated in FIG. 7 so that the OCV 51 turns to a state of W4 in FIG. 3, the OCV 51 differs from the state of W3 in that the advanced angle flow passages 43 are connected to the first penetration passage 52*e* and the retarded angle flow passages 44 are connected to the second annular groove 52*d*. As a result, the oil is supplied to the retarded angle chambers 42 and the oil at the advanced angle chambers 41 is in the drained state.

Figure 8:
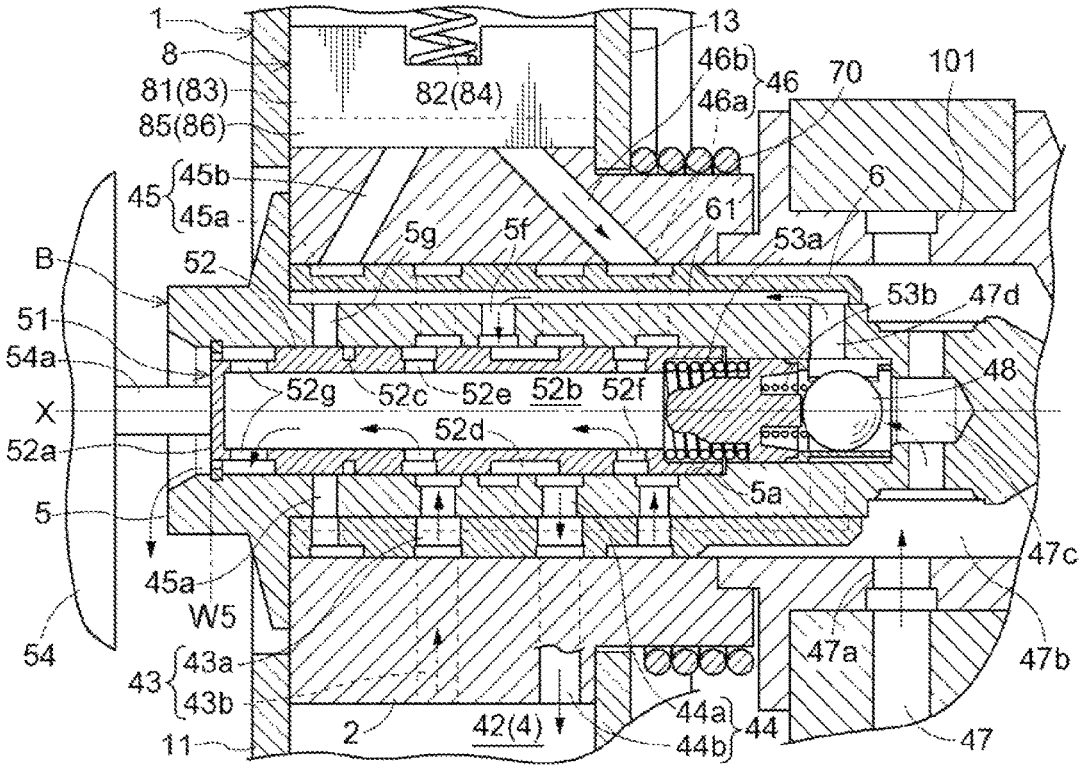
[FIG. 8] is an enlarged cross-sectional view illustrating an operation state of the OCV at W5 in FIG. 3.

In a case where the electromagnetic solenoid 54 is further powered as illustrated in FIG. 8 so that the OCV 51 turns to a state of W5 in FIG. 3, the OCV 51 differs from the state of W4 in that the lock flow passages 45 are inhibited from being connected to the first annular groove 52*c* and the lock discharge flow passages 46 are connected to the second penetration passage 52*f*. That is, without the oil being supplied to the lock flow passages 45, the oil is drained from the lock discharge flow passages 46. As a result, the oil at the intermediate lock mechanisms 8 is drained via the lock discharge flow passages 46. That is, each of the intermediate lock mechanisms 8 is brought to the locked state.

In the present embodiment, as illustrated in FIG. 11, each of the lock flow passages 45 is arranged at a back side (opposite side from the camshaft 101 in the axis X direction) in a direction where the second member 6 is press-fitted to the first member 5 (which is hereinafter simply referred to as a press-fitting direction Y). That is, the lock flow passages 45 are arranged at the back side in the press-fitting direction Y relative to the advanced angle flow passages 43 and the retarded angle flow passages 44. A foreign substance (cutting powder) which is generated by a sliding contact between the members 5 and 6 when the second member 6 is press-fitted to the first member 5 is discharged to a front side in the press-fitting direction Y. As a result, the foreign substance may be reduced to enter the intermediate lock mechanisms 8, thereby decreasing probability of wrong locking (failure to unlock) caused by retention of the foreign substance. The foreign substance discharged to the front side in the press-fitting direction Y may possibly enter the fluid pressure chambers 4. Nevertheless, because the supply and discharge of the oil to the fluid pressure chambers 4 are frequently conducted and an area of the fluid pressure chambers 4 is relatively large, the foreign substance is immediately discharged to the outside. Responsiveness of phase control is inhibited from decreasing.

Different embodiments are explained below. The basic construction of each of the different embodiments is the same as the first embodiment and thus a different construction is only explained with reference to the attached drawings. For easy understanding of the drawings, the same names and reference numerals for components as the first embodiment are employed.

[Second Embodiment]

Figure 12:
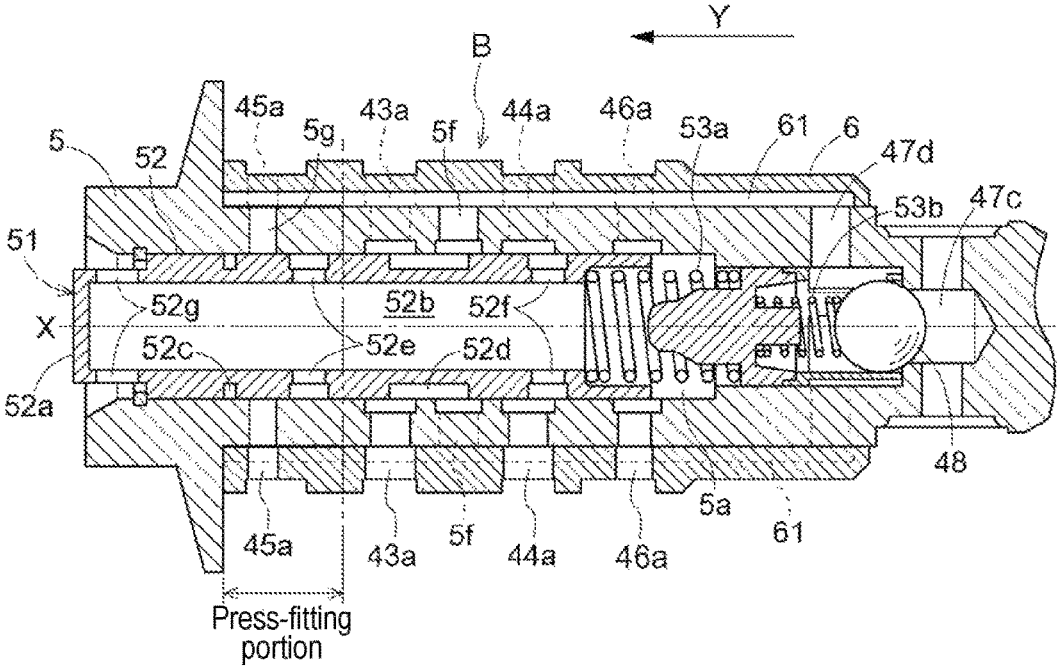
[FIG. 12] is a longitudinal section view of the bolt according to a second embodiment.

As illustrated in FIG. 12, in a second embodiment, a portion of the second member 6 at the back side in the press-fitting direction Y relative to the advanced angle flow passages 43 and the retarded angle flow passages 44 is only press-fitted to the first member 5. Accordingly, a press-fitting range is reduced to further restrain a foreign substance. At this time, the portion of the second member 6 press-fitted to the first member 5 may be at the front side (the side where the camshaft 101 is provided) in the press-fitting direction Y relative to the advanced angle flow passages 43 and the retarded angle flow passages 44.

In the phase retention mode where the supply and discharge of the oil relative to the advanced angle chambers 41 and the retarded angle chambers 42 are interrupted as illustrated in FIG. 6, the oil at the fluid pressure chambers 4 may be possibly discharged to the outside via a small clearance defined between the outer rotor 12 and the front plate 11 or the rear plate 13, for example. In this case, the relative rotational phase is unstable, so that phase retention is not appropriately performed. Nevertheless, according to the second embodiment, a small clearance is provided between the first member 5 and the second member 6 in the vicinity of the advanced angle flow passages 43 and the retarded angle flow passages 44 so that the oil at the supply flow passages 61 may enter the fluid pressure chambers 4 via the aforementioned clearance. As a result, a lack of the oil at the fluid pressure chambers 4 is compensated to restrain instability of the relative rotational phase.

[Third Embodiment]

Figure 13:
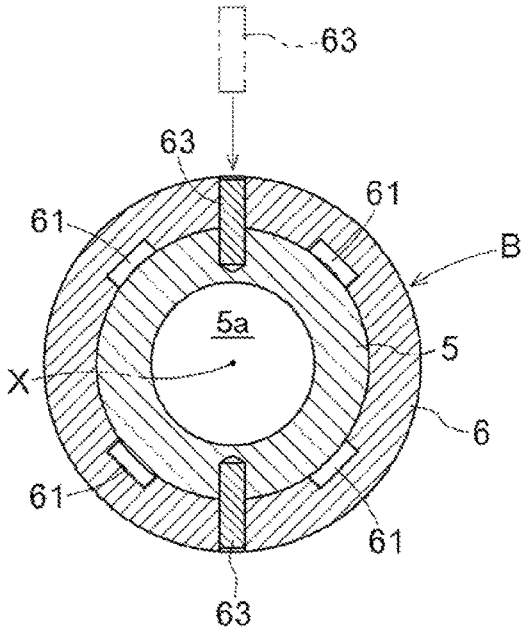
[FIG. 13] is a cross-sectional view of the bolt in a state where the bolt is viewed in an axis direction according to a third embodiment.

As illustrated in FIG. 13, in a third embodiment, plural pins 63 (each of which serves as an example of a fixing member) are provided for blocking a movement of the second member 6 relative to the first member 5 in the circumferential direction. The plural pins 53 are provided in a manner that each of the pins 63 is arranged over the first member 5 and the second member 6 in the radial direction. The pin 63 also includes a function to block the movement of the second member 6 relative to the first member 5 in the axis X direction. Each of the pins 63 is disposed between the supply flow passages 61 as viewed in the axis X direction so that the pins 63 do not interfere with the flow passages formed at the bolt B. The position of the pin 63 in the axis X direction may be between the lock flow passage 45 and the advanced angle flow passage 43 or between the advanced angle flow passage 43 and the retarded angle flow passage 44. The pin 63 is not limited to be disposed at a specific position. In addition, the single pin 63 may be provided instead of the plural pins 63.

In the third embodiment, a position displacement between the first member 5 and the second member 6 which occurs in conjunction with the rotation of the inner rotor 2 may be inhibited by the pins 63. In addition, the position of the second member 6 relative to the first member 5 in the circumferential direction is determinable by matching positions of bores which are provided at the first member 5 and the second member 6 so that the pins 63 are inserted to be positioned within the respective bores. As a result, an easy assembly is achievable. Further, because the relative rotation between the first member 5 and the second member 6 is inhibited by the pins 63, the second member 6 may be mounted to the first member 5 by intermediate fitting or loose fitting. As compared to a case where the second member 6 is press-fitted to the first member 5, occurrence of a foreign substance along with the sliding contact between the members 5 and 6 may be inhibited.

[Other Embodiments]

(1) In the aforementioned embodiment, the bolt B is constituted by the two members, i.e., the first member 5 and the second member 6. Alternatively, the bolt B may be constituted by a single member or more than three members. When the first flow passage 5*g* of the first member 5 is formed in a state where the bolt B is constituted by the single member, a penetration bore is formed at the bolt B in the radial direction and thereafter a cover member is fitted to the penetration bore, for example, so that the first flow passage 5*g* serving as a blind passage may be obtained.

(2) A thermal expansion rate of metal constituting the first member 5, for example, may be greater than a thermal expansion rate of metal constituting the second member 6, for example. In this case, the members 5 and 6 may be specified to dimensional configurations so that a foreign substance is unlikely to be generated upon press-fitting of the members 5 and 6. In addition, because the first member 5 is more expanded than the second member 6 with temperature increase caused by the operation of the engine E, fitting degree of the members 5 and 6 may improve.

(3) In the aforementioned embodiments, as illustrated in FIG. 10, the plural first flow passages 5*g* and the plural second flow passages 45*a* are alternately arranged at even intervals in the circumferential direction. Alternatively, the single first flow passage 5*g* and the single second flow passage 45*a* may be provided. Further alternatively, the plural first flow passages 5*g* and the plural second flow passages 45*a* may not be provided at even intervals.

(4) In the aforementioned embodiments, the supply flow passage 61 is formed in a recess form along the axis X at the inner surface of the second member 6 within the bolt B. Alternatively, the supply flow passage 61 may be formed in a recess form along the axis X at the outer surface of the first member 5 within the bolt B. Further alternatively, the supply flow passage 61 may be formed in a recess form along the axis X at the inner surface of the second member 6 and the outer surface of the first member 5.

(5) In the aforementioned embodiments, the common supply flow passage 61 is provided for the lock flow passage 45 and for the advanced angle flow passage 43 and the retarded angle flow passage 44. Alternatively, the supply flow passages 61 may be dependently provided for the lock flow passage 45 and for the advanced angle flow passage 43 and the retarded angle flow passage 44. In addition, the number of pumps P is not limited to a specific number.

(6) The pin 63 constituting the fixing member according to the third embodiment is arranged over the first member 5 and the second member 6 in the radial direction. Alternatively, the pin 63 may be arranged over the first member 5 and the second member 6 in the axis X direction. In this case, the length of the pin 63 in the axis X direction may be largely secured to thereby stably fix the first member 5 and the second member 6. The pin 63 is not limited to have a specific configuration and may be formed in a circular column or a prismatic column, for example. A fixing bolt instead of the pin 63 may be employed.

(7) The valve opening and closing timing control apparatus 10 may be constructed to control opening and closing timing of not only an intake valve but also an exhaust valve.

INDUSTRIAL APPLICABILITY

The present invention is applicable to a valve opening and closing timing control apparatus controlling a relative rotational phase of a driven-side rotating body relative to a driving-side rotating body which rotates synchronously with a crankshaft of an internal combustion engine.

EXPLANATION OF REFERENCE NUMERALS

1 housing (driving-side rotating body)
2 inner rotor (driven-side rotating body)
4 fluid pressure chamber
45*a* second flow passage
5 first member
5*g* first flow passage
52 spool
6 second member
61 supply flow passage
63 pin (fixing member)
8 intermediate lock mechanism
10 valve opening and closing timing control apparatus
45 lock flow passage
51 OCV (electromagnetic valve)
101 camshaft
B bolt
C crankshaft
E engine (internal combustion engine)
L intermediate lock phase
P pump
X axis
Y press-fitting direction

The invention claimed is:

1. A valve opening and closing timing control apparatus comprising:

a driving-side rotating body rotating synchronously with a crankshaft of an internal combustion engine;

a driven-side rotating body arranged coaxially with an axis of the driving-side rotating body and rotating integrally with a camshaft for opening and closing valves of the internal combustion engine in a state being fixed to the camshaft by a bolt;

a fluid pressure chamber defined between the driving-side rotating body and the driven-side rotating body;

an intermediate lock mechanism selectively switchable between a locked state in which a relative rotational phase of the driven-side rotating body relative to the driving-side rotating body is locked at an intermediate lock phase between a most advanced angle phase and a most retarded angle phase and an unlocked state in which the locked state is released;

a lock flow passage bringing a working fluid to the intermediate lock mechanism; and an electromagnetic valve including a spool which is arranged at an inner portion of the bolt and controlling supply and discharge of the working fluid relative to the fluid pressure chamber and the intermediate lock mechanism, the lock flow passage including a first flow passage which is arranged between the spool and a supply flow passage in a radial direction and which brings the working fluid to flow from the supply flow passage towards the spool, the supply flow passage bringing the working fluid supplied from a pump to flow along an axial direction at the inner portion of the bolt, the lock flow passage including a second flow passage which is provided at the inner portion of the bolt in a penetrating manner in the radial direction and which brings the working fluid to flow from the spool towards the intermediate lock mechanism, at least a portion of the first flow passage and at least a portion of the second flow passage being positioned within a same plane orthogonal to the axis, wherein the bolt is constituted by a first member screwed on the camshaft and a second member arranged along an outer surface of the first member, the supply flow passage is defined between the first member and the second member, the first flow passage is defined at the first member, the second member is press-fitted to the first member along the axial direction, an end portion of the second member at an opposite side from the camshaft in the axial direction is press-fitted to the first member, a flow passage which supplies and discharges the working fluid to and from the fluid pressure chamber is arranged between the first and second flow passages and the camshaft in the axial direction, and only the end portion of the second member at the opposite side from the camshaft in the axial direction relative to the flow passage which supplies and discharges the working fluid to and from the fluid pressure chamber is press-fitted to the first member.

2. The valve opening and closing timing control apparatus according to claim 1, wherein a fixing member which blocks a movement of the second member relative to the first member in a circumferential direction is provided over the first member and the second member.

* * * * *